US005421620A

United States Patent [19]

Sauerwine

[11] Patent Number: 5,421,620

[45] Date of Patent: Jun. 6, 1995

[54] ECCENTRIC C-FOLD ENVELOPE WITH INSERTS FOR BOOKLETS AND RETURN MAILERS

[75] Inventor: Dean N. Sauerwine, Emmaus, Pa.

[73] Assignee: Moore Business Forms, Inc., Grand Island, N.Y.

[21] Appl. No.: 141,015

[22] Filed: Oct. 26, 1993

[51] Int. Cl.[6] ..... B25D 27/06

[52] U.S. Cl. ..... 283/116; 283/117; 229/301; 229/303; 229/304

[58] Field of Search ..... 283/116, 117; 229/68 R, 229/301, 303, 304

[56] References Cited

U.S. PATENT DOCUMENTS 1,995,183 3/1935 Kovnat .
2,777,631 1/1957 Zalkind .
2,983,431 5/1961 Turan .
3,428,237 2/1969 Dowen .
3,718,277 2/1973 Volkert ..... 229/92.8 X
3,726,471 4/1973 Kalb .
3,858,792 1/1975 Volkert .
3,883,069 5/1975 Volkert .
3,899,381 8/1975 O'Brien ..... 462/6 X
3,920,267 11/1975 Lyon, Jr. ..... 281/16
3,952,942 4/1976 O'Leary et al. .
4,011,985 3/1977 Simson .
4,113,281 9/1978 Halse .
4,229,926 10/1980 Rowling .
4,566,720 1/1986 Goldman et al. .
4,638,940 1/1987 Skokos et al. .
4,676,526 6/1987 Redman ..... 462/64 X
4,705,298 11/1987 Van Malderghem et al. .
4,709,850 12/1987 Wagner .
4,717,176 1/1988 Matthews ..... 229/68 R X
4,730,767 3/1988 Gendron .
4,754,915 7/1988 Steidinger .
4,778,100 10/1988 McGuire et al. .
4,799,618 1/1989 Jenkins ..... 229/92.3
4,801,076 1/1989 Schoenleber et al. ..... 229/92.8 X
4,830,269 5/1989 Jenkins .
4,840,306 6/1989 Lombardo .
4,852,795 8/1989 Volk, Jr. .
4,860,946 8/1989 Braud .
4,880,255 11/1989 Zehner, Jr. ..... 229/69 X
4,896,823 1/1990 Taylor .
4,912,909 4/1990 Stenner ..... 493/216 X
4,915,287 4/1990 Volk et al. .
4,927,072 5/1990 Jenkins et al. .
5,015,137 5/1991 Stenner .
5,039,000 8/1991 Ashby .
5,052,977 10/1991 Irvine ..... 462/6
5,104,146 4/1992 Schulz et al. ..... 281/15.1
5,174,491 12/1992 Taylor et al. .
5,174,493 12/1992 File .
5,174,494 12/1992 Ashby .
5,201,464 4/1993 File .

*Primary Examiner*—Frances Han
*Attorney, Agent, or Firm*—Nixon & Vanderhye

[57] ABSTRACT

A C-fold mailer having a return envelope, booklet insert or both is disclosed. The mailer is formed from a relatively large web sheet having two transverse fold lines that separate the sheet into three rectangular sections. Discrete strips of heat seal glue or other adhesive are applied along sections of the edges of one side of the web. In addition, the web is printed with mailing and promotional information and lines of weakness, e.g., perforations, are selectively scored across the web. Furthermore, inserts such as a booklet and return envelop may be included in the mailer.

14 Claims, 4 Drawing Sheets

200
222
220
132
128
102
218
SCREENED INSIDE OF RETURN ENVELOPE
130
216
232
230
231
124
120
108
122
126
218'
216'
116
104
112
138
114
110
RETURN ADDRESS AREA
206
106
212
204
144
112
210
OUTGOING ADDRESS AREA
210
RETURN ADDRESS AREA
202
208
PLEASE APPLY POSTAGE
142
140

ECCENTRIC C-FOLD ENVELOPE WITH INSERTS FOR BOOKLETS AND RETURN MAILERS

FIELD OF THE INVENTION

The invention relates to mailers of the type having separable inserts such as for return envelopes and informational booklets. In addition, the invention relates to a C-fold type envelope.

BACKGROUND OF THE INVENTION

Mailers are widely used as business forms. It is desirable to manufacture mailers simply and economically with high-speed printers and web processing devices. It is advantageous for mailers to be functionally versatile and adaptable to a variety of business form applications. In addition, it is a benefit for mailers to include inserts, such as return envelopes and booklets, so that the recipient of the mailer can easily respond to the mailer and retain information from the mailer.

It is known to form mailers from folded webs. For example, C-folded mailers are formed from a web sheet that is folded in a "C" pattern to form a three layer mailer. Examples of C-fold mailers are shown in U.S. Pat. Nos. 5,174,491; 5,174,493, and 4,896,823. Similarly, mailers can be formed by folding webs in "Z" patterns and side-to-side patterns as is shown in U.S. Pat. Nos. 5,174,493 and 4,840,306. These patents which are assigned to the same owner as this application are incorporated by reference.

SUMMARY OF THE INVENTION

The current invention, relates to a C-fold mailer having a return envelope, booklet insert or both. The mailer is formed from a relatively large web sheet having two transverse fold lines that separate the sheet into three rectangular panels. Discrete strips of heat seal glue or other adhesive are applied along sections of the trim edges on one side of the web. The lines of weakness, e.g., perforations, are selectively scored across the web. Furthermore, inserts such as a booklet and return envelop may be included in the mailer. To form the C-fold mailer, the third panel is folded over the middle panel. The first panel folds over the third and middle panels. The folded sheet is sealed by heat activating the adhesive strips on the sheet.

The mailer conveys various types of printed information. For example, an outgoing address printed on the third panel of the sheet is visible from the outside of the folded mailer through a clear plastic film in the middle panel. In addition, printed information inside the mailer may include a return address on a return envelope, advertising promotions, ordering forms and instruction booklets. Upon receipt of the mailer, the recipient tears open the mailer along a perforated line of weakness along one of the folded edges of the mailer to access the enclosed printed information. The recipient may also tear the mailer in two to separate the return envelope from the booklet formed integrally in the mailer. The number of pages of the booklet can be increased by fluing sheets into the mailer.

DETAILED DESCRIPTION OF THE DRAWINGS

Figure 1:
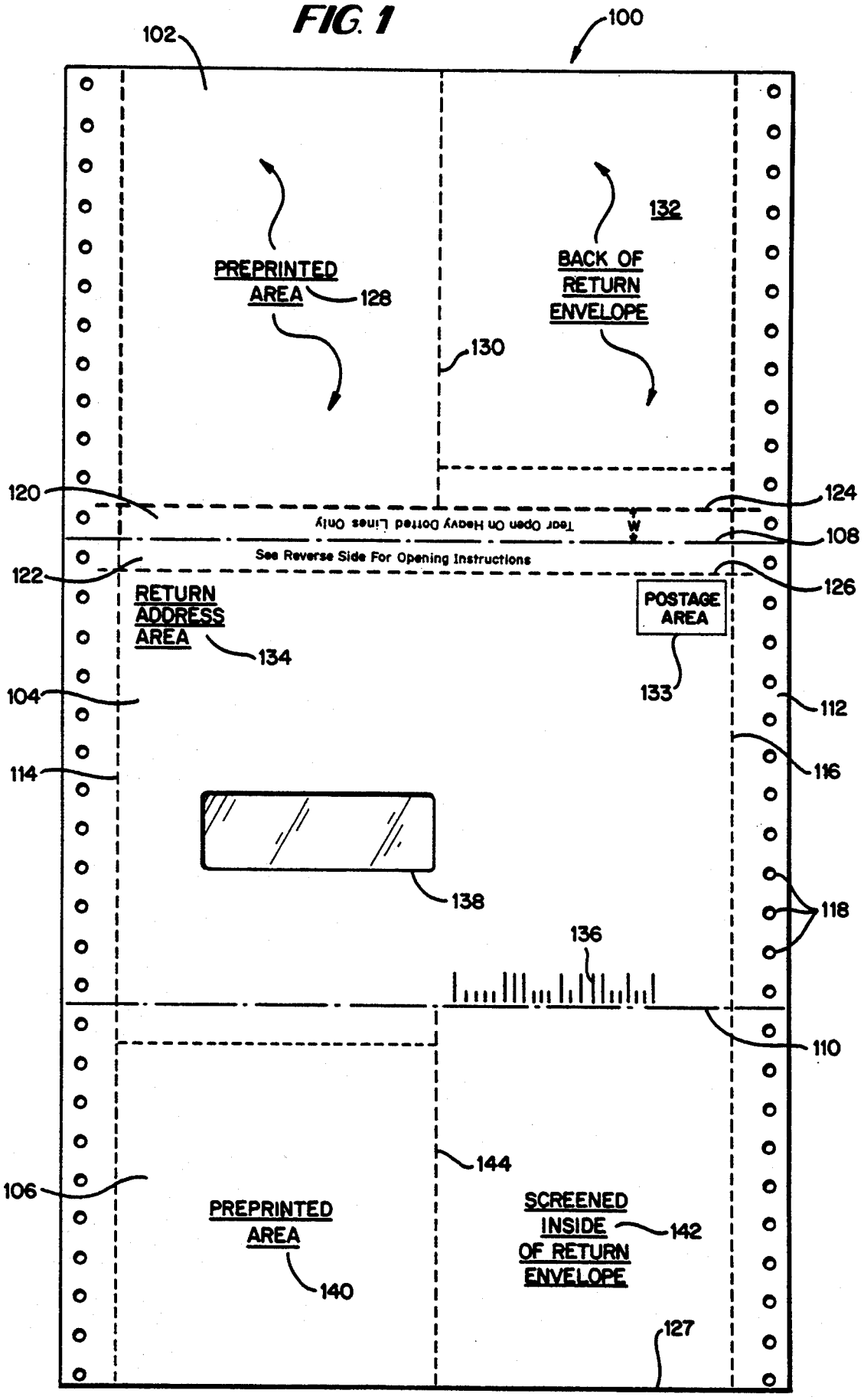
FIG. 1 shows a first surface of a web sheet that folds into a mailer according to a first embodiment of the mailer of the invention.

FIG. 1 shows a first surface 100 of a single web sheet that may be folded as a mailer having a three sheet thickness. The mailer comprises a first end panel 102, a middle panel 104 and a second end panel 106. The transverse edges of the panels are separated by lines of weakness 108, 110, e.g., perforated lines. Edge trim strips 112 along the sides of the panels are separable from the rest of the web sheet along lines of weakness 114 and 116. These trim strips may include perforations that engage a web handling device to handle the web. For example, holes 118 in the trim strips may receive the teeth of a tractor feeder (not shown). An inner portion of the trim strips, in this embodiment, are not removed prior to mailing, because they are coated with adhesive strips used to seal the mailer. An outer portion of the trim strips, having the tractor feed holes, are slit off the form prior to mailing, and open prior to bursting individual sheets from a web or prior to sealing the form together.

The first end panel 102 and the middle panel 104 have substantially the same outer dimensions, e.g., 9½ inches by 6 inches, such that they substantially overlap when one panel is folded over the other. Both the first end panel and middle panel have adjacent transverse tear strips 120 and 122 on either side of the line of weakness 108. The tear strips are separable from the rest of their respective panels by lines of weakness 124 and 126. The height (w) of both tear strips is substantially the same such that they overlap when the first end panel folds over the middle panel. The folded mailer is opened by gripping the overlapping tear strips and tearing the strips away from the mailer.

The second end panel 106 has substantially the same transverse width, e.g., 6 inches, as the other panels. The height of the second end panel, e.g., 5 inches, is less than that of the other panels by a distance equal to or greater than the height of a tear strip 120 or 122. When the second end panel folds over the middle panel, the outer edge 127 of the second end panel falls short of the line of weakness 126 adjacent the tear strip 122. Since the second end panel does not extend to the tear strips 120, 122 of the folded mailer, no portion of the second end panel is torn when the tear strips are peeled away to open the mailer.

The first surface 100 of the mailer has several areas suitable for printed information. For example, the first end panel which forms the back outer side mailer has a first rectangular sheet 128 on which information may be printed on both the front and back pages of the sheet. These two pages may be included in a booklet formed within the mailer. The sheet 128 is bounded on two sides by the line of weaknesses 114 and 124 for the trim and tear strips 112, 122, respectfully. A line of weakness 130 segregates the first sheet 128 from an adjacent return envelope back panel 132 that also occupies a portion of the first end panel. The return envelope back panel may be glued to a corresponding envelope front panel 142 from the second end panel 106 when the mailer is folded and sealed.

Figure 2:
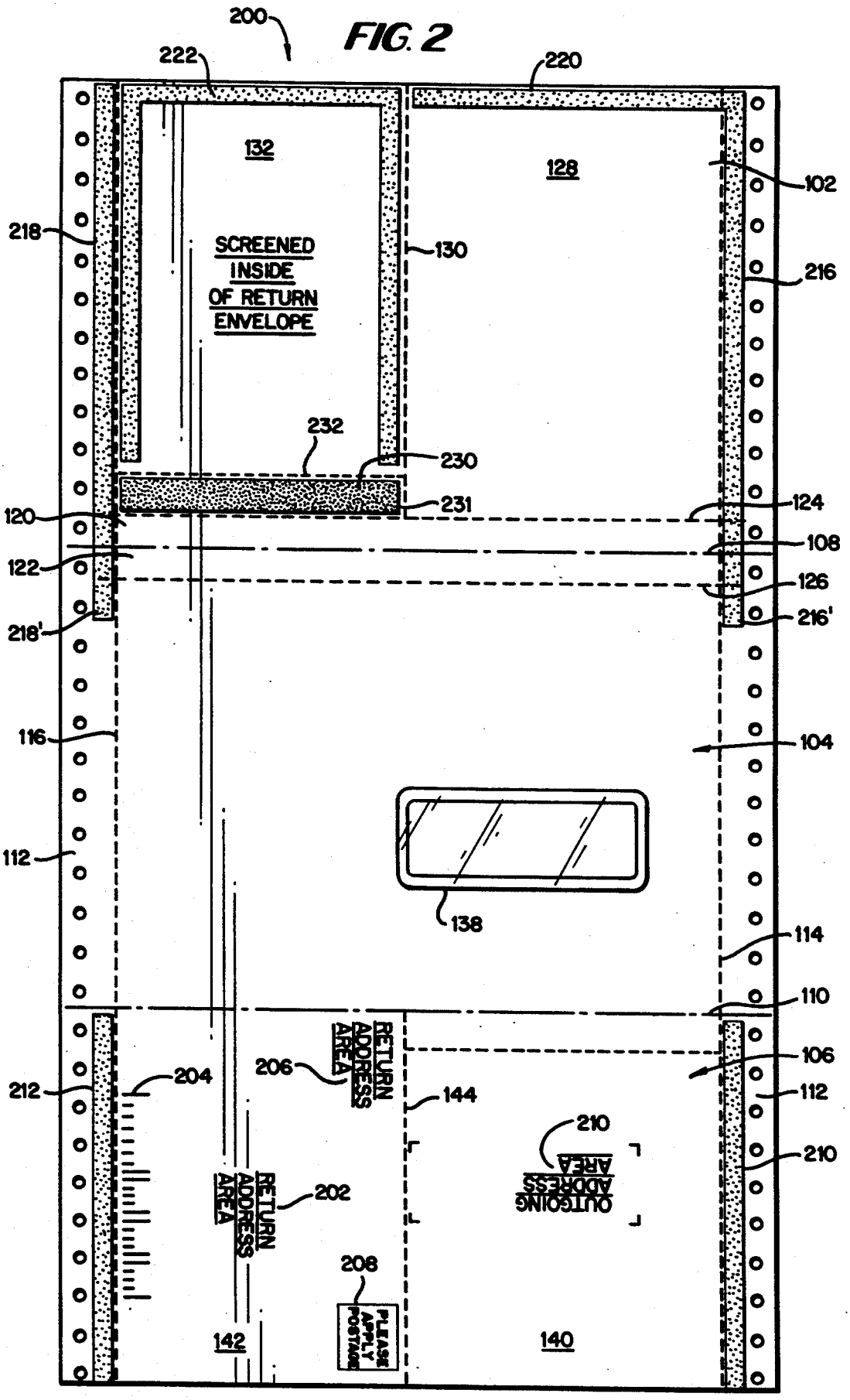
FIG. 2 shows a second, opposite face of the web panel shown in FIG. 1.

The first surface 100 of the middle panel 104 is the front of the mailer and may have a postage field 133, return address field 134, mailer bar code field 136 and an address field 138 that may be a clear plastic sheet through which is visible a mailing address printed on the second end panel 106 (FIG. 2). The first surface 100 of the second end panel 106 may include a second sheet section 140 suitable for displaying printed information as two pages of a four-page booklet formed from sheets 128 and 140 in the mailer. Adjacent the first page section 140 is a second section 142, that may form the inside surface of the front sheet of a return envelope. The page section and second surface area are separable along a line of weakness 144.

FIG. 2 shows the second surface 200 of the mailer shown in FIG. 1. The first end panel 102, on the side opposite to that shown in FIG. 1, may be separated along the line of weakness 130 to form the first sheet 128 of a booklet and an inside surface 132 of a return envelope. The second surface of the middle panel 104 may serve as the inside surface of the front of the mailer having the address view screen 138. The inside surface of the middle panel is suitable for printed information. The second end panel 106 may be segregated along a line of weakness 144 into a front surface of the return envelope front panel 142 and a sheet 140 of a booklet. The second surface 200 of the return envelope may contain fields for a return envelope address 202, mailing bar code 204, return address 206 and postage 208. Similarly, the second surface of the sheet 140 may contain a mailing field 210 that is displayed through a clear window 138 in the folded mailer.

Adhesive coated areas on the second surface 200 seal the folded mailer together. The adhesives may be heat seal glues, pressure sensitive adhesives or other types of adhesives commonly used for mailers and other types of business forms. Extending along the longitudinal edges of the second end panel 106 are a pair of adhesive strips 210, 212 located on the trim strips 112. Similarly, a pair of adhesive strips 216, 218 extend the longitudinal width of the first end panel 102 and are located on the trim strips 112. Whereas the adhesive strips 210, 212 on the second end panel only extend the width of that panel, the adhesive strips 216, 218 on the first end panel extend beyond the first end panel into the middle panel 104. These adhesives strips 216, 218 extend as adhesive stubs 216', 218' on the middle panel by a distance, e.g., one inch, approximately equal to the difference in the width of the first and second end panels.

The adhesive strips on the trim strips are arranged such that the longitudinal edges of the second end panel are completely sealed to the corresponding edges of the middle end panel. Similarly, the edges of the first end panel are completely sealed over a short exposed portion of the middle end panel and over the first surface 100 of the second end panel. By partially overlapping the adhesives strips 216, 218 over themselves when the first end panel is folded over the second end panel, the double adhesive strips stiffen the folded tear strips 120, 122 so that the tear strip is easier to remove.

In addition to the longitudinal adhesive strips on the trim strips, the mailer includes adhesive strips to seal the transverse edge of the first end panel and to form the return envelope. A first transverse adhesive strip 220 extends partially across the width of the first end panel and adjacent the outer edge of the panel. Another adhesive strip 222 extends in a U-shaped pattern around three sides of the return envelope back panel 132. The transverse strip 220 and the transverse portion of the return envelope strip 222 seal the outer edge of the first end panel to the first surface 100 of the second end panel to seal the mailer together. In addition, the U-shaped adhesive strip 222 adheres to the front panel 142 of the return envelope to form that envelope within the mailer.

The return envelope is separated from the mailer by removing the tear strips 120, 122, tearing off the left-hand tear strip 112, and pulling out the booklet formed with sheets 128 and 140. A sheet from the booklet or other web portion may be inserted into the return envelope before it is mailed. A rewettable glue 230 extends across a flap 231 on one side of the return envelope seals a flap defined by fold line 232 over an edge of the return envelope to close that envelope.

Figure 3:
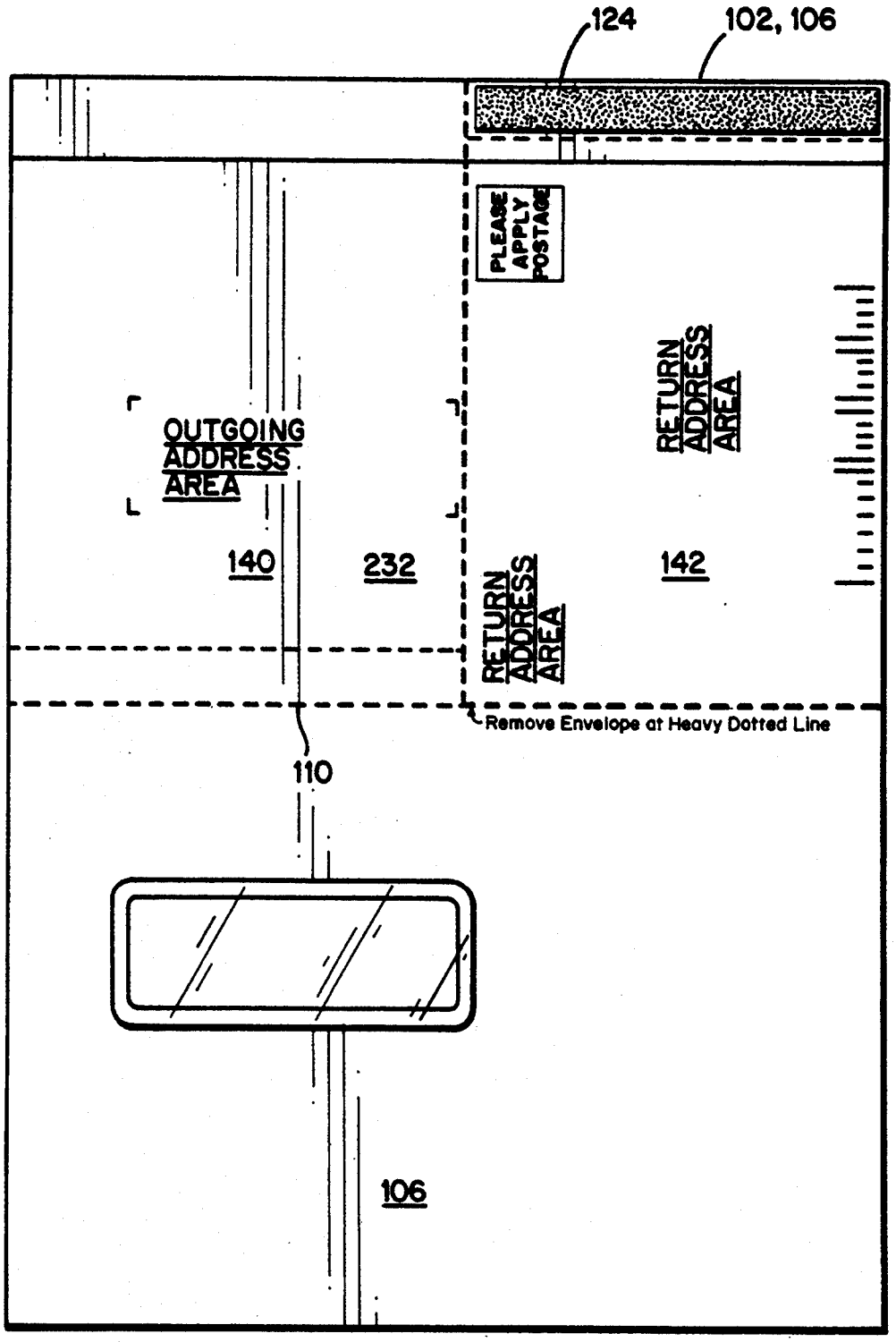
FIG. 3 illustrates an opened mailer in accordance with the first embodiment of the invention.

The mailer is folded by first folding the second end panel over the middle panel and then the first end panel over the second end panel. The folded mailer is processed, e.g., with heat and pressure, to activate the adhesive strips to seal the mailer together. Once the mailer is received in the mail, it is opened by removing the tear strips 120, 122 and the trim strips 112. The mailer is then folded open as shown in FIG. 3 wherein the middle panel 106 and the sealed together end panels 102, 106 form the two halves of the unfolded received mailer. The middle panel can be torn from the end panels and discarded. The end panels can themselves be torn in half to separate the return envelope 142 and the booklet 232 composed of the sheet 140 from the second end panel and the sheet 128 from the first end panel held together by adhesive strip 220.

Figure 4:
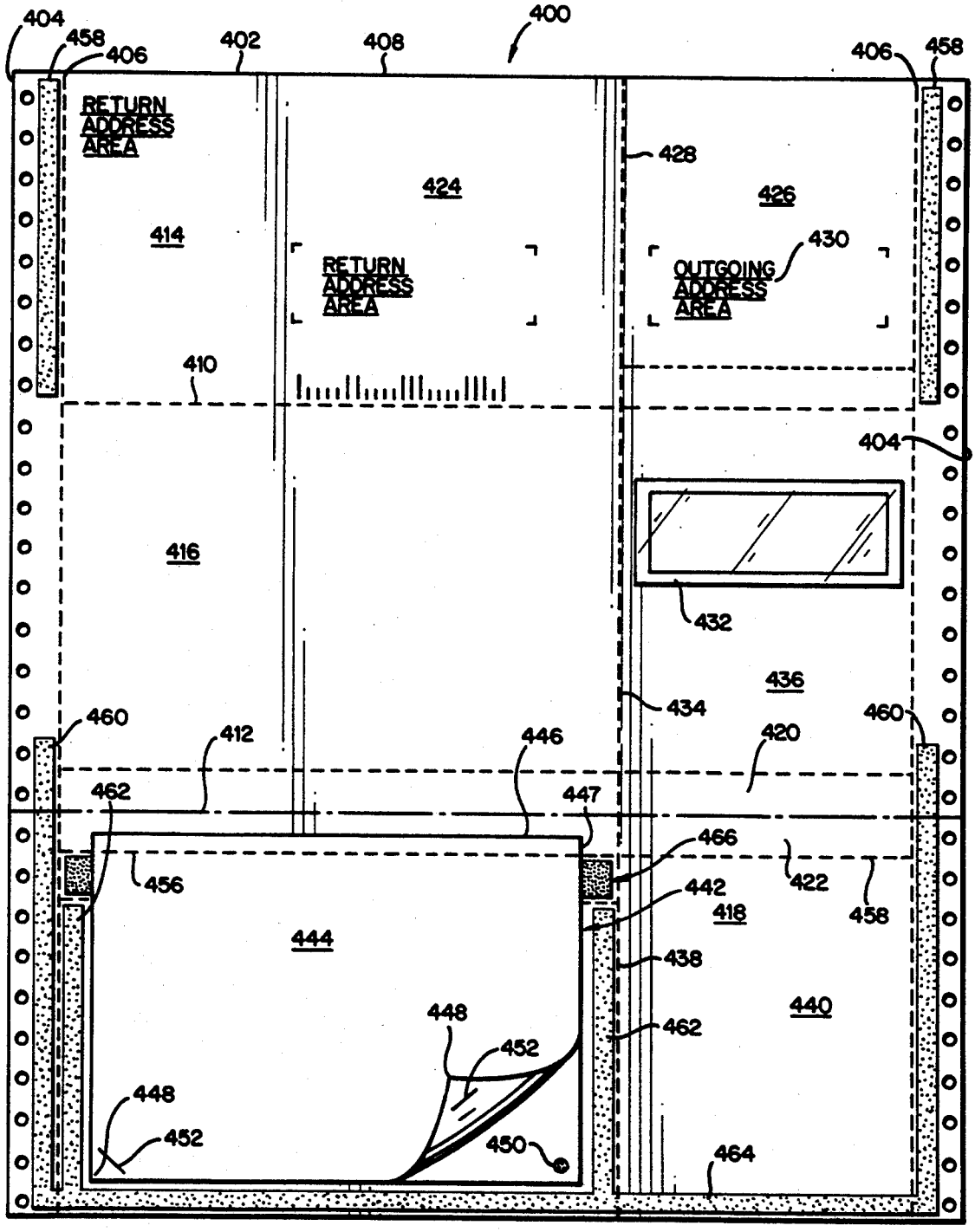
FIG. 4 illustrates a mailer in accordance with a second embodiment of the invention.

A second mailer embodiment 400 is shown in FIG. 4. As does the first mailer embodiment shown in FIGS. 1 to 3, the second embodiment is formed from a web sheet 402 that may have edge trim strips 404 that are separated by a line of weakness 406 from the body 408 of the web. The sheet 402 is transversely divided by fold lines 410 and 412 into a first end panel 414, middle panel 416 and a second end panel 418. The transverse width of the web 408 may be relatively wide, e.g., 11 inches. The length of the middle and second panels, e.g., 5 inches, is longer than the length of the first panel, e.g., 4 inches. As in the first embodiment, the short first panel when folded partially covers the middle panel so as not to overlap onto the tear strips 420 and 422 of the middle and second end panels, respectively.

In the second embodiment, the first end panel may be divided into a return envelope front sheet 424 and a first booklet sheet 426 by a line of weakness 428. The second embodiment may be sufficiently wide to allow the return envelope front panel to be oriented transversely on the sheet 400 rather than longitudinally as is shown in the FIG. 2. An outgoing address field 430 on the first booklet sheet has the printed outgoing mailer address. The middle panel 416 forms the front of the outgoing folded mailer and may contain a clear plastic window 432 through which the outgoing address 430 becomes visible when the first end panel is folded over the middle panel. The middle panel may have a longitudinal line of weakness 434 that allows a portion 436 of the middle panel to be a sheet in the booklet formed in the mailer.

The second end panel 418 is divided along a line of weakness 438 into a sheet 440 of the booklet and the rear panel 442 of the return envelope. The inside surface (shown in FIG. 4) of the rear panel of the return envelope has attached a removable insert sheet 444 that is in the return envelope when the folded mailer is open by the recipient. The insert sheet is attached to the rear panel of the envelope along the top edge 446 of the sheet by a strip 447 of adhesive on the underlying portion of the second end panel 418. The adhesive strip 447 for the insert sheet is positioned on the tear strip 422 of the rear end panel. In addition there is a line of weakness 456 that extends transversely across the insert sheet and that is aligned with the line of weakness 458 for the tear strip on the rear end panel. When the folded mailer is opened by tearing off the folded tear strips 420, 422, the tearing action also removes the top edge of the insert sheet 446 and the underlying adhesive strip 447. By tearing away the top edge 446, the top portion of the insert is no longer attached to the return envelope and can be readily removed by pulling on the top portion that extends up from the return envelope.

The bottom edge of the insert sheet is attached at its corners 448 by adhesive spots 450 on the underlying portion of the rear end panel. These adhesive spots 450 and the adhesive strip 447 may be a conventional permanent adhesive to hold the insert sheet in place during the mailer forming process. The bottom corners 448 of the insert sheet 444 are partially slit 452 so that the insert sheet can be easily pulled out of the return envelope by tearing out the bottom corners 448 at the slits 452. Once the insert sheet is removed, the information printed on the sheet may be used by the recipient to, for example, order desired merchandise by writing ordering information on the insert sheet, and then placing the completed insert sheet back into the return envelope for mailing.

The mailer sheet 400 includes a series of adhesive strips, such as heat seal adhesive strips, for sealing the folded mailer. These adhesive strips are located on one surface of the mailer, in the preferred embodiment. As in the first mailer embodiment, the first end panel includes a pair of longitudinal strips 458 located along the trim strips 404. Similar longitudinal adhesive strips 460 on the trim strips extend the length of the second end panel and partially onto the middle panel. The second end panel also includes a pair of longitudinal adhesive strips 462 adjacent the edges of the rear panel 442 of the return envelope that seal the rear panel to the front panel 424 of the return envelope. In addition, a transverse adhesive strip 464, e.g., formed of a heat seal adhesive, is adjacent the bottom edge of the second end panel to seal that edge to the back of the first end panel when the mailer is folded. Furthermore, a transverse strip 466 of rewettable adhesive adjacent the top edge of rear panel of the return envelope is not activated until the recipient seals the return envelope.

In operation, the mailer sheet bearing printed information is folded and the heat seal adhesives 458, 460, 462, 464 are activated to seal the mailer together. Upon receipt, the mailer is opened by tearing off the folded tear strips 420, 422. A booklet formed of sheets 426, 436 and 440 is separated from the mailer by tearing the mailer along the overlapping lines of weakness 428, 434 and 438. Similarly, the trim strips are torn off the booklet. The booklet is held together by a portion of the transverse adhesive strip 464 that holds together the sheets 426 and 440 from the end panels and the sheet 436 from the middle panel is held in the booklet by the folded edge 410 between the middle panel and the first end panel. In addition, the return envelope and enclosed insert sheet 444 are separated from the middle panel 416 by tearing so that the return envelope can be sealed using the rewettable adhesive 466 after the insert sheet has been reinserted into the envelope.

The invention has been described in its currently preferred embodiment. The invention is not limited to this embodiment. Rather, the invention covers a variety of variations and modifications within the terms and spirit of the attached claims.

What is claimed is:

1. A mailer business form comprising:

an outgoing envelope comprising a web sheet folded along a pair of first and second transverse fold lines to form a first end panel, middle panel and second end panel, wherein said second end panel is shorter in length than said first end and middle panels which have substantially the same length;

said first end panel including a rear panel for a return envelope integrally formed with said outgoing envelope, and a first end panel booklet sheet, a pair of adhesive strips extend longitudinally along trim strips adjacent longitudinal edges of said web sheet and longitudinal return envelope adhesive strips on said rear panel, said first end panel being folded over said middle panel along said first fold line between said first end panel and said middle panel, and a tear strip on said first end panel adjacent said first transverse fold line;

said middle panel including a tear strip extending transversely adjacent said first fold line between, and a pair of adhesive strip stubs extending longitudinally along said trim strips from said first fold line and across said tear strip;

said second end panel including a front panel for said return envelope and a second end panel booklet sheet attached to said first end panel booklet sheet by an adhesive strip extending transversely adjacent an edge of said first end panel opposite to the first fold line, said second end panel having longitudinal adhesive strips extending along said trim strips.

2. A C-fold mailer as in claim 1 where said adhesive strips are formed of heat sealed adhesives.

3. A C-fold mailer as in claim 1 wherein said middle panel includes a clear window that overlaps an outgoing address on said first end panel and visible through said window when said mailer is folded.

4. A C-fold mailer as in claim 1 wherein said second end panel includes an insert sheet releasably attached to said rear panel of said return envelope.

5. A C-fold mailer as in claim 4 wherein said insert sheet is attached with adhesives to said tear strip of said second end panel.

6. A C-fold mailer as in claim 4 wherein said insert sheet is attached at corners of said sheet by adhesive spots near a distal end of said second end panel.

7. A C-fold mailer as in claim 1 further comprising a booklet formed of said first and second end panel booklet sheets and separable along overlapping transverse lines of weakness on said first and second end panels.

8. A C-fold mailer as in claim 7 wherein said middle panel includes a middle panel booklet sheet that overlaps said first and second end panel booklet sheets when said mailer is folded, and a line of weakness separating said middle panel booklet sheet from a remainder portion of said middle panel.

9. A C-fold mailer business form comprising:

an outgoing envelope comprising a web sheet folded along a pair of first and second transverse fold lines to form a first end panel, middle panel and second end panel, wherein said second end panel is shorter in length than said first end and middle panels which have substantially the same length;

said first end panel including a front panel for a return envelope integrally formed with said outgoing envelope and a first end panel booklet sheet, a pair of adhesive strips extend longitudinally along trim strips adjacent longitudinal edges of said web sheet, said first end panel being folded over said middle panel along said first fold line between said first end panel and said middle panel;

said middle panel including a tear strip extending transversely adjacent a second fold line between said middle panel and said second end panel, and a pair of adhesive strip stubs extending longitudinally along said trim strips from said second fold line and across said tear strip;

said second end panel including a rear panel for said return envelope and a second end panel booklet sheet attached to said first end panel booklet sheet by an adhesive strip extending transversely adjacent an edge of said second end panel, said second end panel having longitudinal adhesive strips extending along said trim strips and longitudinal return envelope adhesive strips on said rear panel;

an insert sheet releasably attached to said rear panel for said return envelope along an insert sheet tear strip overlapping a tear strip of said second end panel and said insert sheet being attached at corners by permanent adhesive spots near an opposite end of said second end panel to the tear strip.

10. A C-fold mailer as in claim 9 where said adhesive strips are formed of heat sealed adhesives.

11. A C-fold mailer as in claim 9 wherein said middle panel includes a clear window that overlaps an outgoing address on said first end panel and visible through said window when said mailer is folded.

12. A C-fold mailer as in claim 9 wherein said insert sheet is attached with adhesives to said tear strip of said second end panel.

13. A C-fold mailer as in claim 9 further comprising a booklet formed of said first and second end panel booklet sheets and separable along overlapping transverse lines of weakness on said first and second end panels.

14. A C-fold mailer as in claim 13 wherein said middle panel includes a middle panel booklet sheet that overlaps said first and second end panel booklet sheets when said mailer is folded, and a line of weakness separating said middle panel booklet sheet from a remainder portion of said middle panel.

* * * * *